US005969281A

United States Patent [19]

Suenaga

[11] Patent Number: 5,969,281

[45] **Date of Patent: *Oct. 19, 1999**

[54] HOLDER FOR MUSICAL INSTRUMENT

[75] Inventor: Yuichiro Suenaga, Hamamatsu, Japan

[73] Assignee: Yamaha Corporation, Shizuoka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,351

[22] Filed: Apr. 28, 1997

[30] Foreign Application Priority Data

Jun. 3, 1996 [JP] Japan ..... 8-139985

[51] Int. Cl.[6] ..... G10D 13/02

[52] U.S. Cl. ..... 84/421; 84/422.3; 84/453

[58] Field of Search ..... 84/402, 422.3, 84/421, 403, 453

[56] References Cited

U.S. PATENT DOCUMENTS 3,561,716 2/1971 Thompson ..... 248/286.1

5,262,585 11/1993 Greene et al. ..... 84/645

FOREIGN PATENT DOCUMENTS

S63-7872 3/1988 Japan .

S63-8949 3/1988 Japan .

*Primary Examiner*—Robert E. Nappi

*Assistant Examiner*—Shih-yung Hsieh

*Attorney, Agent, or Firm*—Koda & Androlia

[57] ABSTRACT

A rotation-preventing assembly for preventing rotation of a percussion musical instrument such as a cymbal mounted on a musical instrument stand comprising a fastening member, which is fastened to a holder main body of the stand, and a rotation-preventing member, which is attached to the fastening member. The upper end of the rotation-preventing member is inserted from below into a hole formed in, for instance, a cymbal held on the holder, thus preventing horizontal rotation of the cymbal about the holder.

10 Claims, 2 Drawing Sheets

HOLDER FOR MUSICAL INSTRUMENT

BACKGROUND OF THE INVENTION

1. Field of the Invention

The present invention relates to a holder for holding percussion musical instruments such as electronic cymbals, electronic drums, tom-toms, cow bells, etc.

2. Prior Art

Various types of musical instrument holders for holding percussion instruments such as electronic cymbals, electronic drums, etc., have been proposed in the past as described in, for example, Japanese Utility Model Application Publication (Kokoku) Nos. 63-7872 and 63-8949.

FIG. 2 illustrates a conventional cymbal holder shown partially in cross section.

This cymbal holder 1 includes an attachment pipe 2 which is attached to a musical instrument stand or the body of a bass drum during use, and a holder main body 4 consisting of a pipe is connected to the attachment pipe 2 via an angle adjustment mechanism 3. A seat 5 is attached via a cushion rubber 6, and a pair of felt washers 8 are positioned on the seat 5 so as to hold the electronic cymbal 7 in between. A butterfly nut 9 is screwed onto the upper end of the holder main body 4, thus pressing the upper felt washer 8 against the electronic cymbal 7. The electronic cymbal 7 consists of a cymbal main body 10, which is formed in the shape of a somewhat flat conical disk or fan from a synthetic resin, etc., and a rubber plate 11 is attached so as to cover the striking area of the cymbal main body 10. In addition, a pick-up device 12 such as a piezo-electric element, etc., which converts the vibration of the cymbal main body 10 into an electrical signal, is attached to the undersurface of the edge area of cymbal main body 10. The electronic cymbal 7 has an attachment hole 13 at the center so that the holder main body 4 passes through the center of the cymbal 7. The rubber plate 11 is used in order to restrict the percussion sound, and in order to suppress irregular vibrations.

However, the conventional cymbal holder 1 described above has some problems: although the electronic cymbal 7 is held by two felt washers 8, the cymbal main body 10 oscillates in the circumferential direction with the felt washers 8 as a supporting point when the rubber plate 11 is struck. As a result, gaps are generated between the felt washers 8 and the cymbal main body 10, resulting in that the cymbal main body 10 rotates in the circumferential direction in the horizontal plane.

In the case of an ordinary cymbal, the same problem would not occur since the entire surface of an ordinary cymbal forms the striking portion. In electronic cymbals, however, the striking portion is limited to a region where the rubber plate 11 is installed; accordingly, when the cymbal main body 10 rotates circumferentially, the striking portion is displaced, and playing of the cymbal becomes difficult. Thus, such rotation is undesirable.

SUMMARY OF THE INVENTION

Accordingly, it is a primary object of the present invention to solve the problems with the conventional holders.

It is another object of the present invention to provide a musical instrument holder which can prevent rotation of the percussion instrument that would occur due to percussive vibration, etc. during playing, thus improving the playing characteristics of the instrument.

The objects of the present invention are accomplished by a unique structure for a musical instrument holder that includes a rotation-preventing assembly which is installed on the main body of the holder so as to restrict the movement of the percussion musical instrument in the direction of rotation about the holder.

Furthermore, the present invention is characterized in that the rotation-preventing assembly comprises a fastening member, which is fastened to the main body of the holder, and a rotation-preventing member, which is connected to the fastening member at one end thereof and engages at another end thereof with an engagement means of the percussion musical instrument.

The engagement means of the percussion musical instrument is a hole, and the rotation-preventing member is a rod-form body which enters into the hole.

With the above structure, the movement of the percussion musical instrument, which is, for instance, an electronic cymbal, in the direction of circumferential rotation is restricted by a rotation-preventing assembly engaging with the hole of the percussion musical instrument. Accordingly, the striking portion of the percussion musical instrument is not displaced in the direction of rotation thereof.

DETAILED DESCRIPTION OF THE INVENTION

Figure 1:
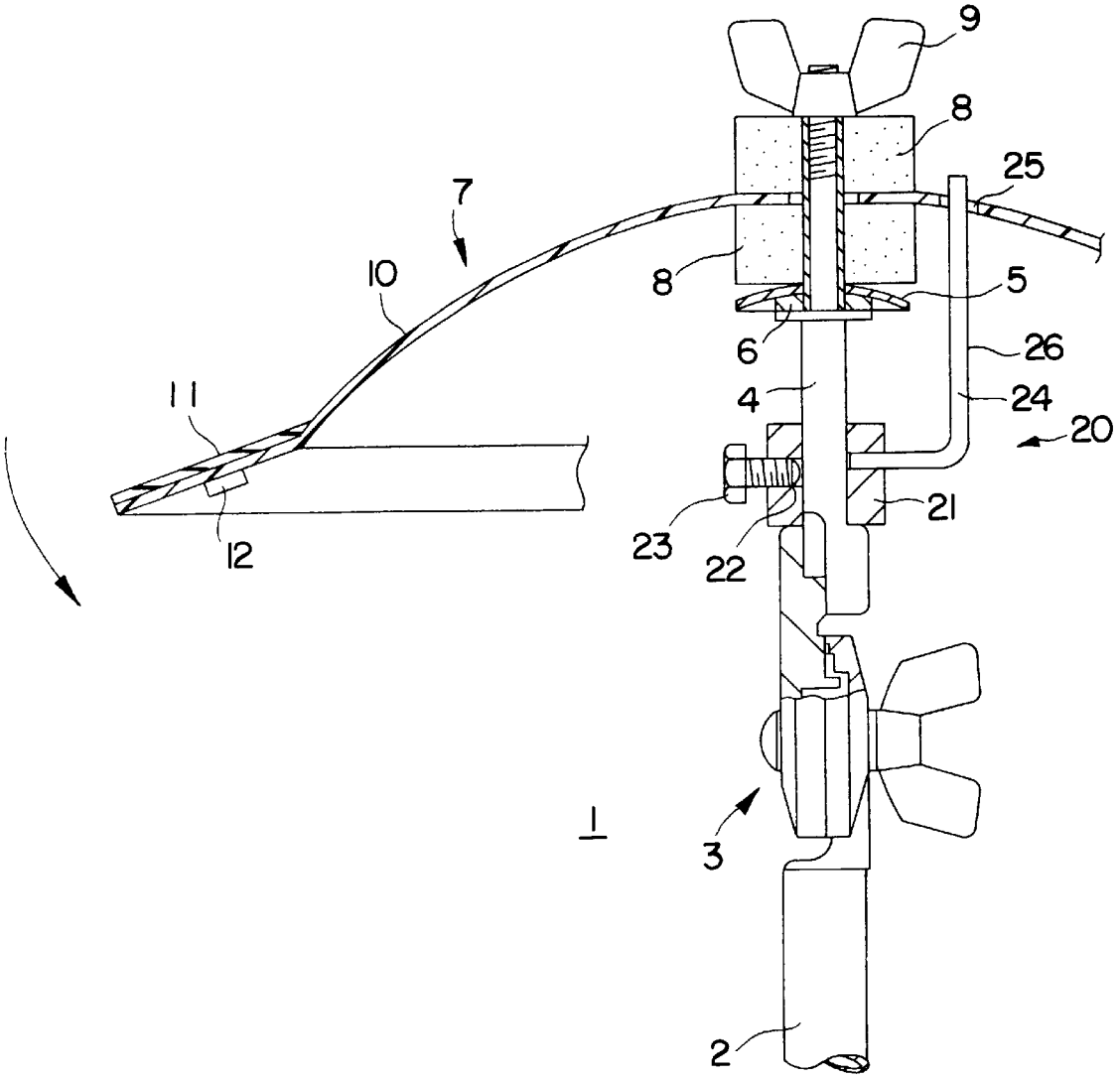
FIG. 1 is a sectional view of one embodiment of the present invention applied to a cymbal holder.
Figure 2:
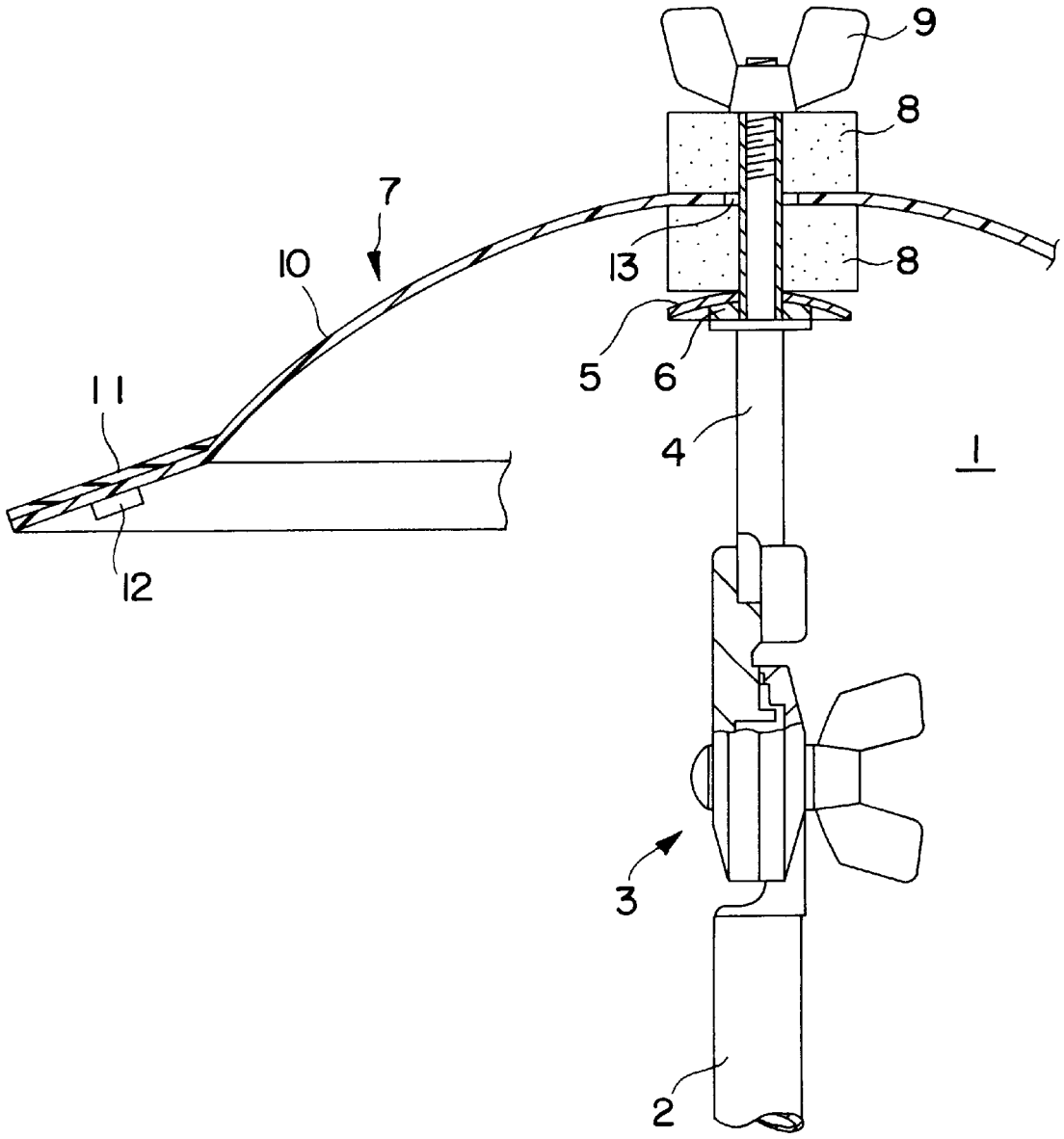
FIG. 2 PRIOR ART
FIG. 2 is a sectional view of a prior art cymbal holder.

One embodiment of the present invention will be described in detail with reference to the accompanying drawings:

FIG. 1 shows one embodiment of the present invention applied to a cymbal holder. Elements which are the same as those in the prior art shown in FIG. 2 are referred to by the same reference numerals, and a detailed description of such elements is omitted.

In the embodiment of FIG. 1, a rotation-preventing assembly 20 is mounted on the holder main body 4 so as to prevent the electronic cymbal 7 from rotating in the horizontal (circumferential) direction or the horizontal plane about the holder main body 4.

In particular, the rotation-preventing assembly 20 comprises a fastening member 21 and a bolt 23.

The fastening member 21 is formed as a cylinder and mounted on the holder main body, and the bolt 23 is screwed into a radially oriented screw hole 22 formed in the fastening member 21, thus securely holding the fastening member 21 on the holder main body 4.

The rotation-preventing assembly 20 further includes a rotation-preventing member 24, which is an L-shaped (reversed L in FIG. 1) rod-form rigid body and is securely attached to the fastening member 21 at one end which is horizontally oriented. The upper end portion of the rotation-preventing member 24 is inserted from below into a thorough hole 25 formed in the electronic cymbal 7. An appropriate gap is formed between the upper end portion of the rotation-preventing member 24 and the inner circumference of the through hole 25 so that the rotation-preventing member 24 has no interference with the vertical vibration of the electronic cymbal 7 during play. The portion of the rotation-preventing member 24 that protrudes from the through hole 25 over the upper surface of the cymbal 7 is set so that it has a dimension disallowing the rotation-preventing member 24 to slip out of the through hole 25 when the electronic cymbal 7 is inclined at the maximum angle in the counterclockwise direction in FIG. 1 as shown by an arrow. In addition, the rotation-preventing member 24 is covered and protected by a piece of heat-shrink tubing 26.

The remaining construction of the holder of the present inventin is substantilly the same as the conventional holder shown in FIG. 2.

In the cymbal holder having a structure described above, the rotation of the electronic cymbal 7 in the horizontal plane can be securely restricted by the rotation-preventing assembly 20 since the upper end of the rotation-preventing member 24 inserted into the through hole 25 of the cymbal 7 comes into cotact with the inner circumference of the through hole 25 when the cymbal 7 makes horizontal or circumferenctial rotation. Accordingly, the position of the striking area of the cymbal 7 does not change during playing, and the distance from the striking portion to the player is maintained and unchanged. Thus, a favorable playing is accomplished with the simple structure of the rotation-preventing assembly 20.

In the above, the embodiment of the present invention is described with reference to a holder used for an electronic cymbal. However, the present invention is not limited to this application. It is possible to apply the present invention so as to prevent rotation of other types of percussion instruments such as ordinary cymbals, electronic drums, tom-toms, cow bells, etc., as well as practice pads.

As described above, the musical instrument holder of the present invention includes a rotation-preventing assembly which restricts the rotational movement of the percussion musical instrument which is attached to the holder. Accordingly, rotation of the percussion musical instrument due to percussive vibration during playing is prevented, thus improving the playing characteristics of the instrument.

I claim:

1. A musical instrument holder for holding a percussion musical instrument, the musical instrument holder comprising:

a main body which holds the percussion musical instrument at an attachment position of said percussion musical instrument; and a rotation-preventing device installed on said main body of said holder, said rotation-preventing device restricts rotational movement of said percussion musical instrument at another position of the percussion musical instrument in a direction of rotation about said attachment position, and said another position is spaced apart from the attachment position.

2. A musical instrument holder according to claim 1, wherein said rotation-preventing device comprises a fastening member, which is fastened to said main body of said holder, and a rotation-preventing member, which is connected to said fastening member and engages with an engagement section of said percussion musical instrument.

3. A musical instrument holder according to claim 2, wherein said engagement section of said percussion musical instrument is a hole, and said rotation-preventing member is a rod-form body which passes through said hole.

4. A musical instrument holder according to claim 2, wherein said percussion musical instrument is an electronic cymbal.

5. A musical instrument holder according to claim 3, wherein said percussion musical instrument is an electronic cymbal.

6. A musical instrument holder according to claim 1, wherein said percussion musical instrument is an electronic cymbal.

7. A musical instrument holder according to claim 1, wherein the attachment position is at a first hole and the another position is at a second hole, and the first and second holes are formed at positions in the percussion musical instrument spaced apart from each other.

8. A rotation-preventive device used in a holder for holding a percussion musical instrument at one end thereof comprising:

a fastening body mounted near one end of said holder, a fastening device fastening said fastening body on said holder at an attachment position; and a rotation-preventing device, one end of said rotation-preventing device secured to said fastening body and an other and of said rotation-preventing device being located inside an engagement hole formed in said percussion musical instrument at another position spaced apart from said attachment position so as to prevent a circumferential rotation of said percussion musical instrument about said attachment position.

9. A rotation preventive device according to claim 8, wherein said rotation-preventing device means is an L-shaped rigid member having said other end thereof engaged with said engagement hole of said percussion musical instrument with a gap in between.

10. A musical instrument holder for holding a cymbal, said musical instrument holder comprising a cymbal support device supporting a central portion of said cymbal and a rotation-preventing device restricting rotation of said cymbal, said rotation preventing device comprising an elongated member coupled at one end to said cymbal support device and extending through a hole provided in said cymbal and spaced apart from said central portion whereby rotation about said central portion is prevented.

* * * * *